United States Patent [19]

Grace

[11] Patent Number: 4,466,353

[45] Date of Patent: Aug. 21, 1984

[54] HIGH VELOCITY JET SHAPED CHARGE

[75] Inventor: Fred I. Grace, York, Pa.

[73] Assignee: The United States of America as represented by the Secretary of the Army, Washington, D.C.

[21] Appl. No.: 478,401

[22] Filed: Mar. 24, 1983

[51] Int. Cl.[3] ..... F42B 1/02

[52] U.S. Cl. ..... 102/307; 102/308; 102/310; 102/476

[58] Field of Search ..... 102/306–310, 102/476

[56] References Cited

U.S. PATENT DOCUMENTS

| | | | |
|---|---|---|---|
| 2,407,093 | 9/1946 | Mohaupt | 102/307 X |
| 2,839,997 | 6/1958 | Church et al. | 102/307 |
| 2,984,307 | 5/1961 | Barnes | 102/307 X |
| 3,215,074 | 11/1965 | Robinson, Jr. et al. | 102/308 X |
| 3,237,559 | 3/1966 | Auberlinder | 102/306 |
| 3,358,780 | 12/1967 | Venghiattis | 102/308 X |
| 3,416,449 | 12/1968 | Brothers | 102/476 |
| 3,477,372 | 11/1969 | McFerrin et al. | 102/307 |
| 3,750,582 | 8/1973 | Kintish et al. | 102/476 |

FOREIGN PATENT DOCUMENTS

| | | | |
|---|---|---|---|
| 2422136 | 12/1979 | France | 102/476 |

OTHER PUBLICATIONS

Delacour et al., *A New Approach Toward Elimination of Slug in Shaped Charge Perforating,* Jour. Petroleum Tech., Mar., 1958.

*Primary Examiner*—Peter A. Nelson

*Attorney, Agent, or Firm*—Robert P. Gibson; Anthony T. Lane; Michael C. Sachs

[57] ABSTRACT

Two sections of explosives are utilized in a shaped charged device to first accelerate liner material to high velocity and secondly to collapse the moving liner on a projectile's longitudinal axis to produce a high velocity jet and slug. The apparatus utilizes the principle of superposition of velocity generated by sequentially activated explosives to attain jet and slug velocities having greater ability to defeat armored targets.

3 Claims, 6 Drawing Figures

HIGH VELOCITY JET SHAPED CHARGE

GOVERNMENTAL INTEREST

The invention described herein may be manufactured, used and licensed by or for the Government for governmental purposes without the payment to me of any royalty thereon.

BACKGROUND OF THE INVENTION

The present invention relates to a high velocity jet shaped charge device which permits the formation of a coherent jet of greater length and mass and higher velocity than previous prior art devices. The present invention when incorporated into a missile or projectile warhead and delivered to an armored target produces substantially increased jet energy, penetration and target damage.

Various means have been used in the past to provide projectiles with enhanced penetrating ability in order to defeat armored vehicles. Prior art shaped charge projectiles frequently relied upon the formation of a metallic high velocity jet for their lethality. The problem with shaped charge devices was that they were limited by physical laws from producing coherent jets with velocities greater than two times the sound velocity of the liner material. Shaped charge devices using liner material made of copper, nickel, and aluminum have produced jet velocities in the 4–11 kilometer per second range.

Previous attempts to produce faster, coherent (non-radially dispersing) jets through various changes in design geometries and different use of materials with exceedingly high sound velocity proved unsuccessful. Shaped charges utilizing beryllium as a liner material produce mostly non-coherent jets, although the jet particle cloud was reported to travel at velocities as high as 22 Km/s. It should be noted however, that even if a beryllium liner could be formed into a coherent jet, the penetration would be low since the density of beryllium is low as compared to copper. In the prior art, it has been possible to produce a high velocity jet tip particle from nickel liners with velocity higher than the physical limitation of two times the sound velocity of the liner material. However, only a small tip particle was contiguous and therefore not useful as an armor penetrator.

PRIOR ART STATEMENT

A cursory review has been made of class 102, subclass 56SC and no disclosure has been found which may be considered pertinent to the present invention.

SUMMARY OF THE DISCLOSURE

The present device comprises two sections of explosives, the first accelerates a liner material to high velocity and the second collapses a moving liner on axis to produce a higher-velocity jet and slug.

An object of the present invention is to provide a shape charge for a projectile which utilizes the principle of superposition of velocity to achieve a jet velocity for a shaped charge which exceed the physical limiations with respect to the material sound velocity.

Another object of the present invention is to provide a shaped charge wherein the jet is formed in two or more stages, the first accelerating the liner to a high velocity, and the second collapsing the moving liner into a coherent jet.

Another object of the present invention is to provide a shaped charge for a warhead wherein the superposition of velocity permits a final jet to have the sum of velocities acquired by a plurality of explosive charges.

A further object of the present invention is to provide a shaped charge for a warhead wherein the acquired velocity of a metallic slug, formed as a result of a plurality of explosive sections, produces a slug velocity sufficiently high to enable it to act as a penetrator or armored vehicles.

BRIEF DESCRIPTION OF THE DRAWINGS

Throughout the following description, like reference numerals are used to denote like parts of the drawings.

DESCRIPTION OF THE PREFERRED EMBODIMENTS

Figure 1:
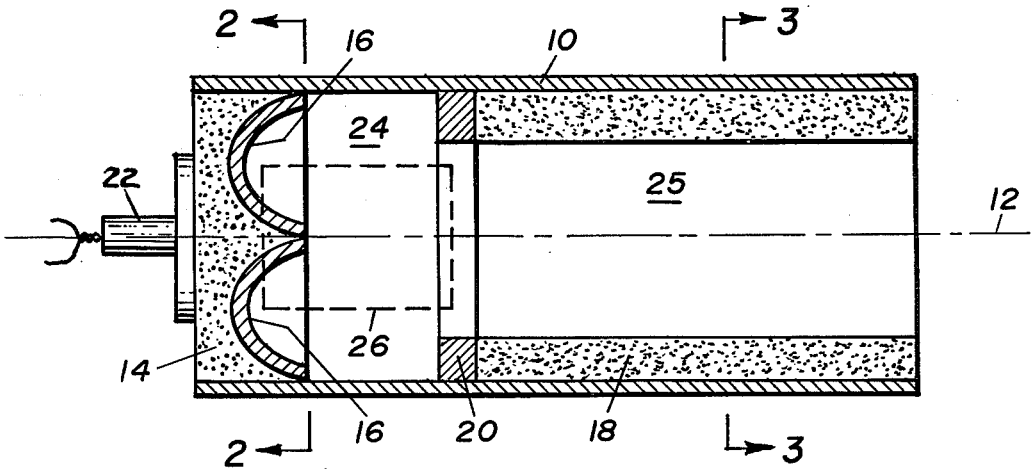
FIG. 1 is a longitudinal view of a high velocity shaped charged device.
Figure 2:
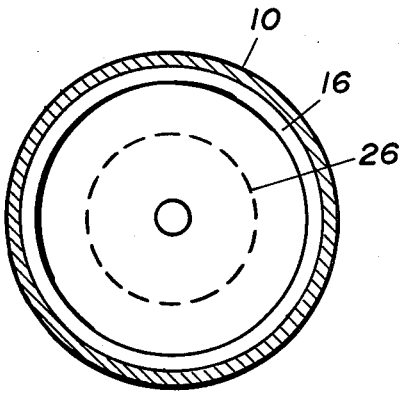
FIG. 2 is a cross-sectional view taken along line 2—2 of FIG. 1.
Figure 3:
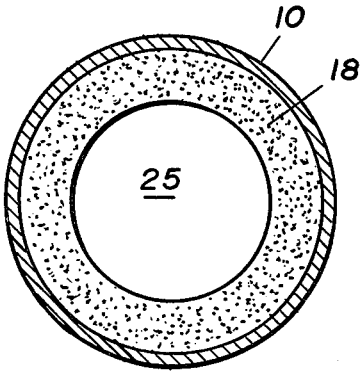
FIG. 3 is a cross-sectional view taken along line 3—3 of FIG. 1.
Figure 4:
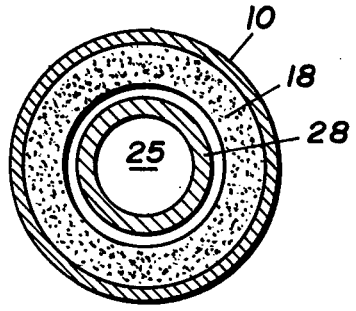
FIG. 4 is a cross-sectional view taken along line 4—4 of FIG. 5.

Referring now to FIGS. 1–3, the present invention comprises a thin cylindrical housing 10 having a longitudinal axis 12. Positioned in one end of housing 12 is a first explosive charge 14 which has a front end in contact with an annular accurately shaped metallic liner 16. A hollow cylindrical second explosive charge 18 is positioned in housing 10 at a nominal distance from the first explosive charge 14. Positioned intermediate first explosive charge 14 and second explosive charge 18 is an annularly shaped delay member 20. Axially positioned in abutment with the rear end of first explosive charge 14 is a detonator 22. The spaces 24 and 25 between charges 14 and 18 respectively, and within charge 18 contain ambient air.

The first or main explosive charge's 14 function is to provide energy for accelerating liners 16 axially in the direction of the second explosive charge 18. The first explosive charge 14 does not necessarily have to be cylindrically shaped as shown, but, depending upon design requirements, could be tapered toward one end or curved, for example. First explosive charge 14, in other embodiments could have an axial hole therein containing nothing more than ambient air. Liner 16 provides the metal which is ultimately used to form a high velocity jet or slug. Various metals having different densities can be selected depending upon the particular target sought to be penetrated. The configuration of liner 16 may be of various contours, but is required to form a moving metallic tube 26, shown in ghost outline in FIGS. 1 and 2. The metallic tube 26 moves toward the second explosive charge 18 sequentially enters, and is entirely contained within second explosive charge 18. Second charge 18 generally will be of a configuration compatible with the shape of the metallic tube 26, which is formed. However, the second charge 18 does not have to be in contact with the metallic tube 26 as it enters air space 25. A small clearance may be designed into the system such that small variations in the housing formation do not cause undesired impact initiation of the second charge 18. In addition layers of shock mediating materials may serve as an interior line to second charge 18, or be used for protective purposes in and around the second charge 18. Detonation of the second charge 18 may be initiated either by electronic timing or a delay initiator 20 as shown in FIG. 1. The detonation of the second charge 18 collapses the metallic tube shown to have the ghost outlet 26 of FIG. 1, on the device axis whereupon a jet and slug are formed.

Figure 5:
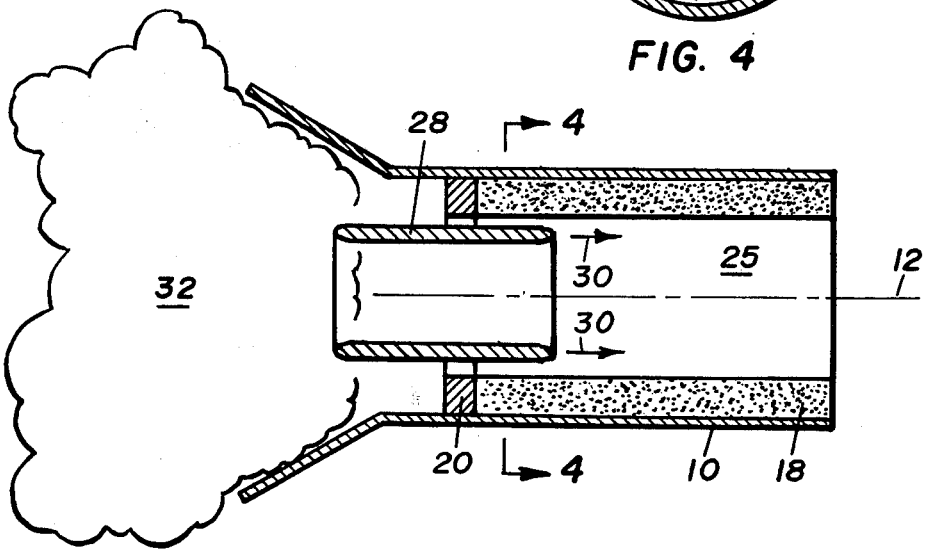
FIG. 5 is a partial cross-sectional view showing the formation of a metallic tube from a first charge detonation.

Referring now to FIGS. 1, 4–6, in operation detonator 22 produces single point or annular detonation wave in first explosive charge 14. The detonation begins at the left hand side of FIG. 1 and sweeps toward the right. As the detonation wave reaches liner 16 it forces the liner 16 forward while simultaneously moving the liner material 16 toward the hypothetically shown ghost cylindrical surface 26. The liner 16 may collapse on itself about the hypothetical surface 26 in two possible ways. Firstly, it can form a jet in the configuration of a "cookie cutter" device, or secondly it can form all the liner material 16 into a cylindrical self-forged fragment 28, as shown in FIG. 5. Typical forward velocities for the first possibility is 4–10 km/sec. and for the second possibility approximately 5 km/sec. Either possibility can be chosen for any particular design, however, the configuration of the liner 16 must reflect that choice. Once the metallic tube 28 is formed it moves toward second explosive charge 18 as indicated by arrows 30. Initiation of second charge 18 is delayed by delay member 20, until the metallic tube 28 is completely contained within the cavity 25. The detonation front 40 of the second explosive charge 18 sweeps over the moving metallic tube 28. There is a general requirement that the detonation velocity of the second explosive charge 18 be greater than the velocity of the metallic tube 28. Under these conditions the detonation forces of second charge 18 will accelerate the affected portions of the metallic tube toward the charge axis 12.

Figure 6:
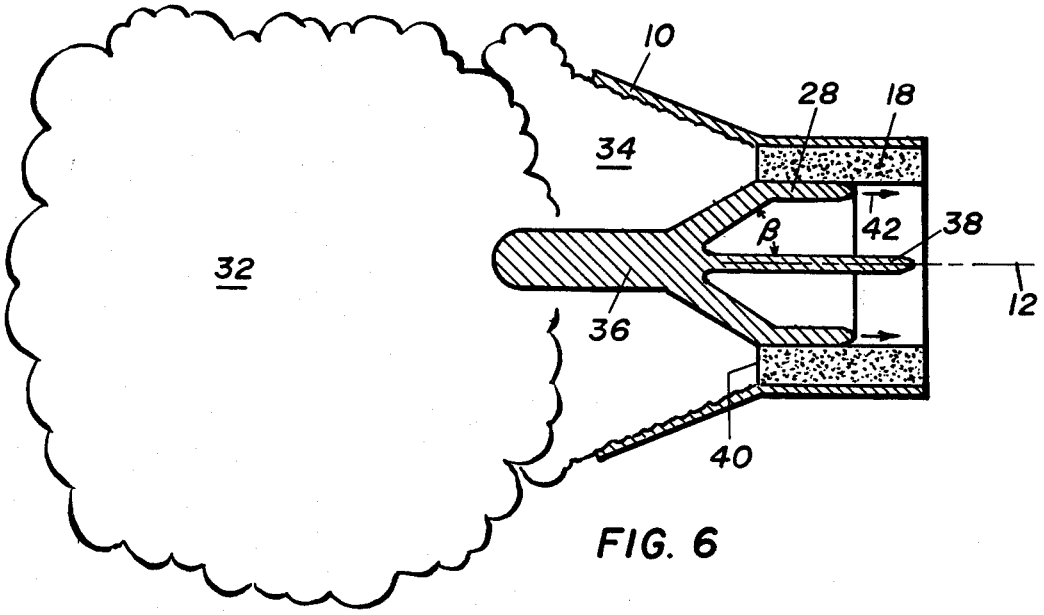
FIG. 6 is a partial cross-sectional view showing collapse of the moving metal tube during a second charge detonation.

Referring now to FIG. 6, the acceleration caused by the detonation front 40 and the explosive gas expansion 34 produced by the second charge 18, appears first on the left portions of the metallic tube 28, and successively in time moves over the metallic tube 28 from left to right. The sweeping effect causes the metallic tube 28 to bend through an angle B, the collapse angle, similar to the collapse processes occuring in conventional shaped charges. The bending effect aforedescribed, jet formation 38, and slug 36 are shown for example at a time when the detonation front 40 and expansing gas 34 has proceeded to approximately half the distance along the length of the second charge 18.

In accordance with the present teaching, the preferred embodiment utilizes an explosive section 14 to form a metallic tube 28 moving at a high velocity 30, and a second explosive charge 18 to collapse the high velocity metallic tube 28 to produce a slug 36 and a jet 38 with significantly higher velocity along the charge axis 12. Thus, for the present invention the final jet velocity includes the aforementioned limitation velocity plus the velocity of the moving tube 28 before collapse of the second explosive charge 18. The theoretical limit of the jet velocity for the present invention is twice that which can be produced from a conventional shaped charge. The relative motion of the liner in form of a metallic tube 28, and the detonation rate of the second explosive charge 18 assure large collapse angles B, relatively massive jets, and jet coherency. The higher velocity jet and slug permits greater jet length at a given distance from the charge 18 and allows devices to be designed with greater penetration capability.

The foregoing disclosure and drawings are merely illustrative of the principles of this invention and are not to be interpreted in a limiting sense.

I wish it to be understood that I do not desire to be limited to the exact details of construction shown and described for obvious modifications will occur to a person skilled in the art.

I claim:

1. A shaped charge device which comprises:

a hollow cylindrical shaped housing having a longitudinal axis;

first explosive means, including an explosive charge having substantially cylindrical shape operatively disposed in one end of said housing, for generating a first detonation wave;

detonator means comprising means for producing a single point or annular detonation wave in said first explosive means operatively positioned on the outer side of said first explosive means for selectively initiating explosion in said first explosive means;

shaped charge liner means in abutment with and at the inner side of said first explosive means, said inner means forming a convex hollow toroid surface, convex in the direction of the said first explosive means, which deforms upon explosion into an approximate hollow open ended tube-shaped first slug expelled at a first velocity, preceded by a narrow first jet of high velocity gases of the explosion, said liner being metal which density is varied for use in defeating various targets, delay means comprising an annular shaped delay member placed to the rear of said liner means;

said explosive means having a detonation velocity rategreater than said first velocity of said first slug, said second explosive means shaped as a hollow cylinder fitting within said housing, having an inside diameter slightly larger than the outside diameter, and length greater than length of, said first slug, placed to the rear of said delay means and initiated by a second detonation initiation wave transmitted from said delay means, said delay means delaying transmission of said second detonation initiation wave until said first slug is completely contained within the length of said second explosive means, whereby when said second explosive means is detonated, the said first slug is deformed into a second slug which is relatively rod-shaped, expelled at a second velocity, preceeded by a second jet of relatively high velocity gases of the second explosion,

2. A shaped charge device which comprises:

a hollow cylindrical shaped housing having a longitudinal axis;

first explosive means, including an explosive charge having substantially cylindrical shape operatively disposed in one end of said housing, for generating a first detonation wave;

detonator means comprising means for producing a single point or annular detonation wave in said first explosive means operatively positioned on a front end of said first explosive means for selectively initiating explosion in said first explosive means;

shaped charge liner means in abutment with and at the rear of said first explosive means, said liner means forming a hollow parabolic near donut-shaped surface, convex in the direction of the said first explosive means, which deforms upon explosion into an approximate hollow open ended tube-shaped first slug expelled at a first velocity, preceded by a narrow first jet of high velocity gases of the explosion, said liner being metal which density is varied for defeating particular targets.

mechanical delay means comprising an annular shaped delay member placed to the rear of said liner means;

second explosive means having a detonation velocity rate greater than said first slug, said second explosive means shaped as a hollow cylinder within said housing having an inside diameter slightly larger than the outside diameter of said first slug, and having length greater than the length of said first slug, placed to the rear of said delay means, and initiated by a second detonation initiation wave transmitted from said delay means, said delay means delaying transmission of said second detonation initiation wave until said first slug is completely contained within the length of said second explosive means, whereby when said second explosive means is detonated, the said first slug is deformed into a second slug which is relatively rod-shaped, expelled at a second velocity, preceeded by a second jet of relatively high velocity gases of the second explosion.

3. A shaped charge device which comprises:

a hollow cylindrical shaped housing having a longitudinal axis;

first explosive means, indluding an explosive charge having substantially cylindrical shape operatively disposed in one end of said housing, for generating a first detonation wave;

detonator means comprising means for producing a single point or annular detonation wave in said first explosive means, operatively positioned on an outer side of said first explosive means for selectively initiating explosion in said first explosive means;

shaped charge liner means in abutment with and at the rear of said first explosive means, said liner means forming a double parabolic hollow toroid shaped surface, convex in the direction of the said first explosive means, which deforms upon explosion into an approximate hollow open ended tube-shaped first slug expelled at a first velocity, preceded by a narrow first jet of high velocity gases of the explosion, said liner being metal which density is varied for defeating various targets, mechanical delay means comprising an annular shaped delay member placed to the rear of said liner means;

second explosive means having a detonation velocity rate greater than said first velocity of said first slug, said second explosive means shaped as a hollow cylinder with said housing having an inside diameter slightly larger than the outside diameter of said first slug, and having length greater than the length of said first slug, placed to the rear of said delay means, and initiated by a second detonation initiation wave transmitted from said delay means, said delay means delaying transmission of said second detonation initiation wave until said first slug is completely contained within the length of said second explosive means, whereby when said second explosive means is detonated, the said first slug is deformed into a second slug which is relatively rod-shaped, expelled at a second velocity, preceded by a second jet of relatively high velocity gases of the second explosion.

* * * * *